US008810468B2

(12) United States Patent
Cannon et al.

(10) Patent No.: US 8,810,468 B2
(45) Date of Patent: Aug. 19, 2014

(54) BEAM SHAPING OF RF FEED ENERGY FOR REFLECTOR-BASED ANTENNAS

(75) Inventors: Benjamin L. Cannon, Tucson, AZ (US); Byron B. Taylor, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 378 days.

(21) Appl. No.: 13/169,961

(22) Filed: Jun. 27, 2011

(65) Prior Publication Data

US 2012/0326939 A1 Dec. 27, 2012

(51) Int. Cl.

| | |
|---|---|
| ***H01Q 19/12*** | (2006.01) |
| ***H01Q 19/02*** | (2006.01) |
| ***H01Q 19/19*** | (2006.01) |
| ***H01Q 19/06*** | (2006.01) |

(52) U.S. Cl.

CPC ..... *H01Q 19/027* (2013.01); *H01Q 19/12* (2013.01); *H01Q 19/19* (2013.01); *H01Q 19/062* (2013.01)

USPC ..... 343/840; 343/909; 343/755

(58) Field of Classification Search

CPC ..... H01Q 19/12; H01Q 19/19; H01Q 19/027; H01Q 19/062

USPC ..... 343/770, 844, 840, 755, 781 P, 781 CA, 343/909

See application file for complete search history.

(56) References Cited

U.S. PATENT DOCUMENTS

| | | | | |
|---|---|---|---|---|
| 3,394,378 | A * | 7/1968 | Williams et al. | 343/779 |
| 4,689,632 | A | 8/1987 | Graham | |
| 5,068,670 | A * | 11/1991 | Maoz | 343/767 |
| 5,185,608 | A | 2/1993 | Pozgay | |
| 5,214,438 | A | 5/1993 | Brusgard et al. | |
| 5,973,649 | A | 10/1999 | Andressen | |
| 6,295,034 | B1 | 9/2001 | Brown et al. | |
| 6,480,164 | B2 | 11/2002 | Posner et al. | |
| 6,606,066 | B1 | 8/2003 | Fawcett et al. | |
| 6,924,772 | B2 | 8/2005 | Kiernan, Jr. et al. | |
| 7,227,501 | B2 * | 6/2007 | Lange | 343/700 MS |
| 2002/0165001 | A1 * | 11/2002 | Phillips et al. | 455/500 |
| 2010/0238082 | A1 | 9/2010 | Kits Van Heyningen et al. | |

* cited by examiner

*Primary Examiner* — Dieu H Duong
(74) *Attorney, Agent, or Firm* — Eric A. Gifford

(57) ABSTRACT

A beam-shaping element is provided to shape RF feed energy for reflector-based antennas. The RF beam-shaping element is located between the primary reflector and the antenna feed and configured to direct RF energy from the feed away from a blockage created by the feed itself towards unblocked regions of the primary reflector. The beam-shaping element allows for a simplified feed design. The feed may comprise one or more feed elements, each comprising a radiating element and a feed to the radiating element such as a cavity-backed slot radiator and stripline trace. In a monopulse tracking system, each quadrant may include only a single feed element. In common aperture systems, the RF beam-shaping element may be formed on only the rear surface of the secondary reflector that allows transmission at the predefined RF wavelength while reflecting energy of a second predetermined wavelength to another sensor.

17 Claims, 8 Drawing Sheets

BEAM SHAPING OF RF FEED ENERGY FOR REFLECTOR-BASED ANTENNAS

BACKGROUND OF THE INVENTION

1. Field of the Invention

This invention relates to reflector-based antennas, and more particularly to beam shaping of RF feed energy for reflector-based antennas including, but not limited to, single, dual and tri-mode sensors for target tracking.

2. Description of the Related Art

The basic design and operation of reflector-based antennas are well known and well documented in technical literature. In the simplest configuration, one or more RF feed elements are located near the focal point of a reflective surface (e.g. a parabolic dish). The reflective surface acts to collect incoming electromagnetic energy from a distant source in the far field in a particular direction to the feed element(s) in the focal area and/or re-radiate energy from the feed element(s) in a directive fashion towards the same particular direction into the far field. Reflector antennas are used for satellite communication, radio astronomy, target tracking, and many other applications that require a highly directive antenna. One approach for target tracking, commonly referred to as "monopulse tracking", segments the feed into quadrants with one or more feed elements per quadrant and uses sum and difference configurations of the quadrants to estimate target angular position. As used herein, the term "RF" includes the portions of the electromagnetic spectrum commonly referred to as RF, millimeter wave or microwave.

U.S. Pat. No. 5,214,438 discloses a dual-mode sensor including both a millimeter wave and infrared sensor in a common receiving aperture for target tracking. A selectively coated dichroic element is located in the path of the millimeter wave energy on the axis between the feed and the primary reflector. The dichroic element reflects infrared energy from the primary reflector to a focal point and at the same time transmits and focuses millimeter wave energy. An optical system relays the infrared energy to a focal plane behind the primary mirror. The dichroic element transmits and focuses millimeter wave energy without significant attenuation such that optical and millimeter wave energy may be employed on a common boresight. The IR optical system may increase the central blockage of the RF feed pattern. Tri-mode sensors such as disclosed in U.S. Pat. No. 6,606,066 may position a laser spot tracker forward of the RF feed and transceiver. This laser spot tracker may further increase the size of the central blockage.

U.S. Pat. No. 6,295,034 discloses a feed that includes an array of individual elements, specifically four elements per quadrant, for use in common aperture sensor systems for target tracking. The array elements are configured to increase the overall efficiency of a reflector antenna by flattening the aperture illumination, and also by nullifying the illumination within the centrally blocked portion of the reflector antenna surface. More specifically, the array elements are carefully configured with respect to spacing and excitation, for example, such that the array illuminates only the non-blocked portion of the main reflector. In addition, the array pattern is optimized such that the non-blocked portion of the reflector antenna is quasi-uniformly illuminated. In short, the feed elements are configured to direct a majority of RF energy from the feed towards regions of the main reflector that are not blocked by the dichroic element/IR sensor or laser spot tracker. The carefully configured multi-element feed is cited as providing an increasing in efficiency of about 20% over the conventional monopulse feed (e.g. one element per quadrant).

SUMMARY OF THE INVENTION

The following is a summary of the invention in order to provide a basic understanding of some aspects of the invention. This summary is not intended to identify key or critical elements of the invention or to delineate the scope of the invention. Its sole purpose is to present some concepts of the invention in a simplified form as a prelude to the more detailed description and the defining claims that are presented later.

This invention relates to reflector-based antennas, and more particularly to beam shaping of RF feed energy for reflector-based antennas and particularly single, dual and tri-mode target-tracking sensors.

In an embodiment, an antenna feed is located approximately at the focal point of a primary reflector for illuminating the primary reflector with or receiving from the primary reflector radio frequency (RF) energy of a predefined RF wavelength. An RF beam-shaping element is located between the primary reflector and the antenna feed. The RF beam-shaping element is configured to direct RF energy from the feed away from a blockage created by the feed itself towards unblocked regions of the primary reflector. The feed design may be simplified such that the feed illuminates the primary reflector such that in the absence of the beam-shaping element a maximum power density is radiated toward the blockage of the reflector and tapers to a lower density in the unblocked regions. The beam-shaping element reshapes the illumination such that the power radiated toward the blockage is reduced and the majority of the radiated power illuminates the unblocked regions. The simplified feed may comprise a minimum number of feed elements, each comprising a radiating element and feed to the radiating element. The RF beam-shaping element may be formed on the rear surface of a secondary reflector that allows transmission at the predefined RF wavelength while reflecting energy of a second predetermined wavelength to a sensor.

In another embodiment, an antenna feed is located approximately at the focal point of a primary reflector for illuminating the primary reflector with or receiving from the primary reflector radio frequency (RF) energy of a predefined RF wavelength. The feed is segmented into four quadrants, each quadrant comprising a single feed element. A transceiver energizes and accepts RF energy from the single feed element on each quadrant to estimate first and second orthogonal angles (e.g. Azimuth and Elevation) to an illuminated target using sum and difference configurations of the four feed elements. The four feed elements are suitably spaced by approximately one-half the predefined RF wavelength and energized in-phase. Each feed element suitably comprises a radiating element and a feed to the radiating element. The feed may be unexposed or straight. Cavity-backed slot radiators fed by stripline traces being one such example. An RF beam-shaping element is located between the primary reflector and the antenna feed. The RF beam-shaping element is configured to direct RF energy from the feed away from a blockage created by the feed itself towards unblocked regions of the primary reflector.

In another embodiment, an antenna feed is located approximately at the focal point of a primary reflector for illuminating the primary reflector with or receiving from the primary reflector radio frequency (RF) energy of a predefined RF wavelength. A sensor receives or transmits energy of a second predefined wavelength different from the predefined RF wavelength. A secondary reflector is positioned with its forward surface facing the primary reflector and the sensor and its rear surface facing the antenna feed. A selective coating on the forward surface allows transmission of RF energy at the predefined RF wavelength there through and reflects energy of the second predefined wavelength. An RF beam-shaping element is formed on the rear surface of the secondary reflector. The element may, for example, comprise a conical section, printed phase plate or dielectric gradient. The RF beam-shaping element is configured to direct RF energy from the feed away from a blockage created by the feed, secondary reflector and sensor towards unblocked regions of the primary reflector.

These and other features and advantages of the invention will be apparent to those skilled in the art from the following detailed description of preferred embodiments, taken together with the accompanying drawings, in which:

DETAILED DESCRIPTION OF THE INVENTION

Figure 1:
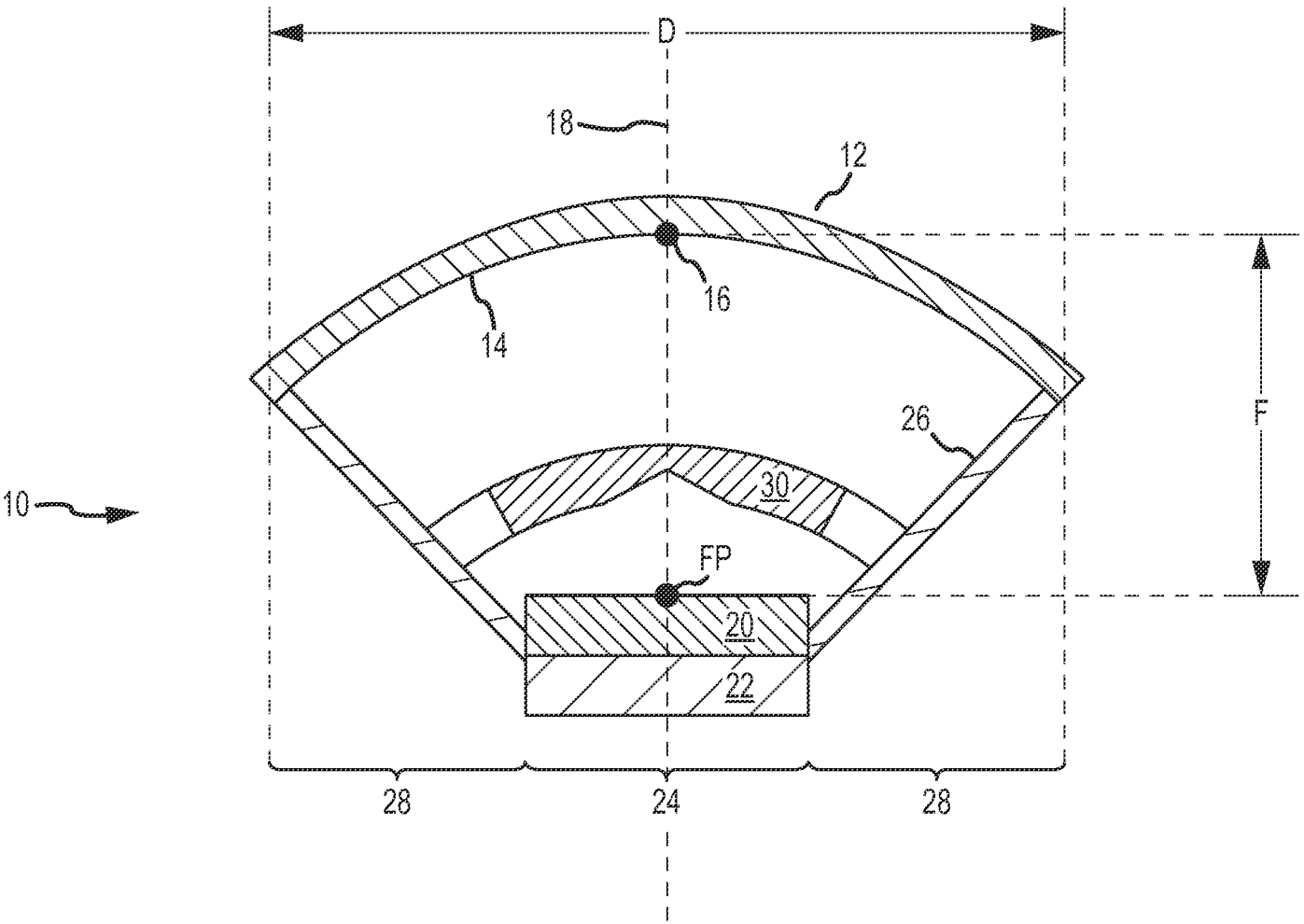
FIG. 1 is a side view of an embodiment of a single-mode reflector-based antenna including an RF beam-shaping element.

The invention describes beam shaping of RF feed energy for reflector-based antennas. A RF beam-shaping element is located between the primary reflector and the antenna feed. The RF beam-shaping element is configured to direct RF energy from the feed away from a blockage created by the feed itself towards unblocked regions of the primary reflector outside the blockage. Inclusion of the beam-shaping element allows for a simplified feed design. The feed may comprise fewer feed elements, each comprising a radiating element and an unexposed or straight feed to the radiating element. The feed design may be simplified such that the feed illuminates the primary reflector such that in the absence of the beam-shaping element a maximum power density is radiated toward the blockage of the reflector and tapers to a lower power density in the unblocked regions. The beam-shaping element reshapes the illumination such that the power radiated toward the blockage is reduced and the majority of the radiated power illuminates the unblocked regions.

The RF beam-shaping element may be incorporated into any system that requires a highly directive reflector-based antenna such as reflector antennas used for satellite communication, radio astronomy, target tracking, and many other applications. The element may be used in systems that transmit, receive or transmit and receive RF energy. The element may be used in center-fed systems in which blockage effects a central region of the primary reflector. The feed may comprise one or more feed elements. The use of the RF beam-shaping element may allow for a simplified feed design including fewer feed elements and unexposed or straight feeds to the radiating elements, which may improve overall RF performance. The network and method of exciting the feed elements and of processing received energy will be determined by the application. The beam-shaping element may be a discrete component or may be integrated with a secondary reflector as in the case of a common aperture system. A second beam-shaping element may be placed between the RF feed and the first RF beam-shaping element to provide additional shaping. The second element may be located close to the emitting/receiving plane of the RF feed near the focal point.

In a monopulse tracking system, each quadrant may include only a single feed element such as a cavity-backed slot radiator fed by a stripline trace. The combination of the beam-shaping element and simplified feed design increases the far field antenna gain while reducing the receive sensitivity to cross-polarized energy. Element-to-element coupling and element-to-trace coupling in the quadrants that often exists and increases cross-polarization levels in a multi-element feed is eliminated by using only one element per quadrant. In common aperture systems, the RF beam-shaping element may be formed on the rear surface of the secondary reflector that allows transmission at the predefined RF wavelength while reflecting energy of a second predetermined wavelength to a secondary sensor (e.g. an IR sensor, a laser tracking sensor or another RF feed tuned to a different RF wavelength). By shaping only the rear surface of the secondary reflector, no performance impact is witnessed on the secondary sensor and no additional physical component is required.

Referring to FIG. 1, a single RF only reflector-based antenna 10 is shown in accordance with an embodiment of the present invention. The antenna 10 includes a primary reflector 12 having a surface 14 that is reflective to at least RF energy (e.g. RF/microwave/milimeterwave). In the exemplary embodiment, the primary reflector 12 has a circular aperture with a diameter D. Primary reflector 12 maps a plane wave at far field to a spherical wave at a focal point FP and vice-versa. Typically, the primary reflector 12 has a parabolic or quasi-parabolic RF cross-section, with focal point FP located at a focal length F from a vertex 16 of the primary reflector 12. This generally parabolic cross-section may be achieved with a physically parabolic cross-section or with a printed phase plate on a physically flat surface in which the printed elements' scattering phases are designed to electrically represent a parabola. Note, in common aperture systems, the IR sensor imposes the generally parabolic shape on the primary reflector. In an RF only optimized design or at least one not driven by IR considerations, the primary reflector may be designed to have a different RF cross-section. In this embodiment, an axis 18 of the antenna 10 extends from the vertex 16 of the primary reflector 12 through the focal point FP. In many applications, axis 18 will coincide with a boresight axis of the antenna where the boresight axis points in the direction in which the reflector antenna is configured to radiate maximum energy. In other applications, the RF axis 18 is offset from the boresight axis.

The antenna 10 further includes an RF feed 20 located generally at the focal point FP of the primary reflector 12. RF feed 20 includes one or more feed elements, each element comprising a radiating element such as a cavity-backed slot radiator or microstrip patch and a feed such as a stripline trace or coaxial pin or microstrip trace to the radiating element. A transceiver 22 excites the individual feed elements to transmit RF energy. The RF feed 20 is positioned to illuminate the primary reflector 12 and reflect maximum RF energy off the primary reflector 12 along the boresight axis 18 in a collimated beam. The RF feed is positioned near focal point FP so as to receive focused RF energy reflected by the primary reflector 12. The received RF energy at the individual feed elements may be received directly by the transceiver 22 or may be provided to an arithmetic network (such as a monopulse network of couplers that performs arithmetic operations and passes formed sum and difference channel energy to the transceiver).

The location and size of RF feed 20 creates a blockage 24 with respect to RF energy on the surface of the primary reflector 12. Support struts 26 also serve to impose blockage on the primary reflector 12. Unblocked regions 28 of the primary reflector 12 surround blockage 24 and define the usable portion of the aperture. The blockage 24 has negative effects on the antenna's performance, including reduction in antenna gain and an increase in side lobe levels.

An RF beam-shaping element 30 is located between the primary reflector and the antenna feed near focal point FP. The RF beam-shaping element 30 is configured to direct RF energy from the feed 20 away from the blockage 24 created by the feed itself towards unblocked regions 28 of the primary reflector 12. The beam-shaping element 30 may be formed from a dielectric material with the shaped interface between the dielectric material and air configured to steer the RF energy. The beam-shaping element may improve the gain of the transmitter antenna's main beam by steering energy that was once wasted due to the blockage and converting it to usable energy that contributes to the collimated main beam. By reciprocity, the beam-shaping element may improve reception of the RF energy as well.

Inclusion of RF beam-shaping element 30 may allow for simpler, more conventional feed designs that still achieve specified gain and side-lobe performance. The feed design may be simplified such that in the absence of the beam-shaping element the feed illuminates the primary reflector such that a maximum power density is radiated toward the blockage of the reflector and tapers to a lower power density in the unblocked regions. The beam-shaping element reshapes the illumination such that the power radiated toward the blockage is reduced and the majority of the radiated power illuminates the unblocked regions. The simplified feed may comprise a reduced or minimum number of feed elements, each comprising a radiating element and a straight or unexposed feed to the radiating element. A simpler feed design may improve overall RF performance of the antenna by, for example, reducing cross-polarization.

Figure 2B:
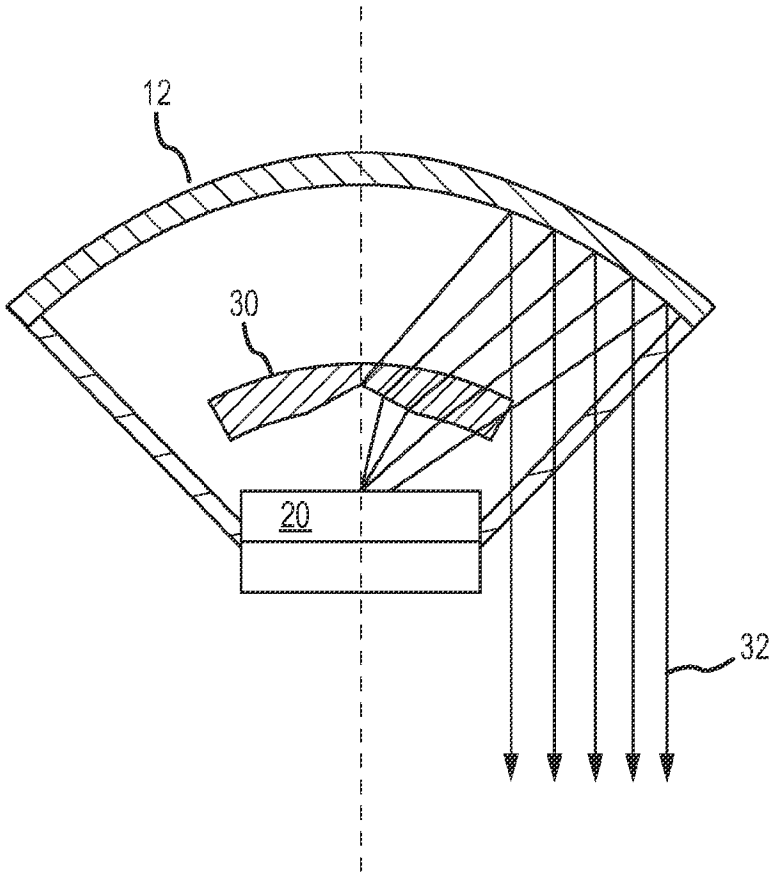
FIGS. 2*a* and 2*b* are ray-tracing diagrams of the single-mode reflector-based antenna without and with the RF beam-shaping element.
Figure 2A:
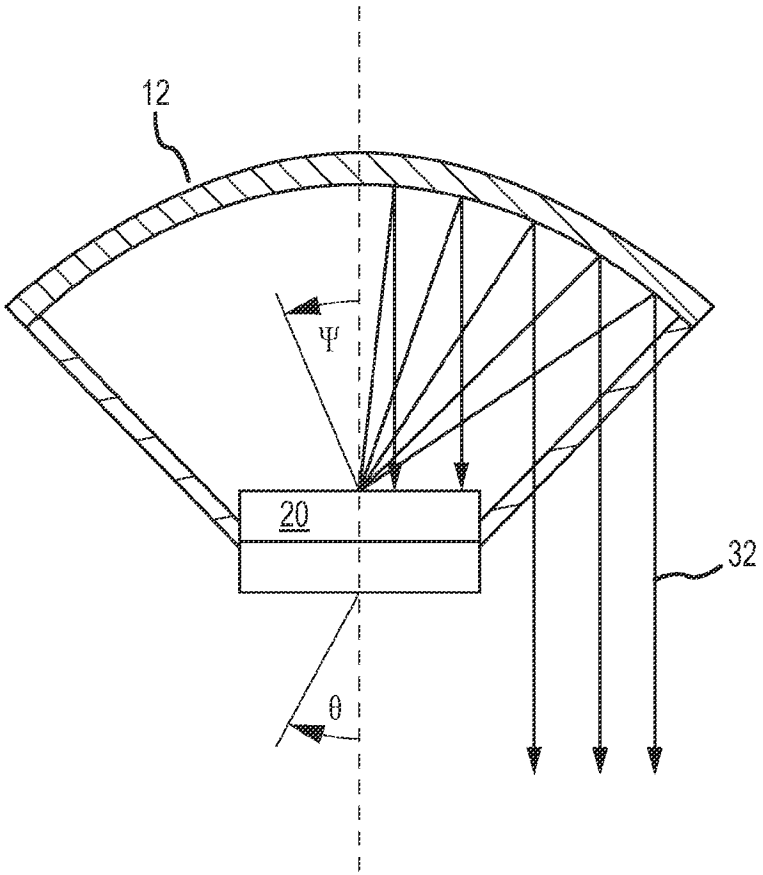

FIGS. 2*a* and 2*b* exhibit a ray tracing of rays 32 launched from feed 20 at an angle psi ($\Psi$) off the primary reflector 12 and out to free space at an angle theta ($\Theta$) as a collimated beam 34 without and with RF beam-shaping element 30. As shown in FIG. 2*a*, a portion of the RF energy is reflected off primary reflector back towards feed 20 and is blocked. In a typical simple feed the highest energy density is radiated at an angle of $\Psi=0$ towards the reflector. Consequently a large portion, possibly a majority, of the radiated energy is blocked. As shown in FIG. 2*b*, RF beam-shaping element 30 directs RF energy away from the blockage towards unblocked regions of the primary reflector. At a fundamental level, the beam-shaping element is net-divergent meaning that, on average, the element causes more energy to diverge than converge. By being net-divergent, the element is capable of steering energy away from the blockage, and towards the usable unblocked regions of the aperture. A divergent beam steering element is capable of mimicking—or even improving—the effects and performance of specially configured feeds that use additional feed elements. In some embodiments, the beam-shaping element may be effective to steer a majority of the RF energy to the unblocked regions and a maximum power density to the unblocked regions.

RF beam-shaping element 30 may be implemented in several possible configurations. In general, the beam-shaping element is typically formed on or in one or more of the surfaces of a dielectric element. In a common aperture system, the beam-shaping element 30 may be formed on the rear surface of the secondary reflector, which is designed to pass the predetermined RF wavelength with minimal attenuation and to reflect a second predetermined wavelength (e.g. IR, laser or different RF wavelength) to a secondary sensor. The beam-shaping element 30 may be formed on only the rear surface in a manner that has no impact on the forward surface and the performance of the secondary reflector to reflect the second predetermined wavelength or the secondary sensor. The element may, for example, be implemented as a conical cutout, printed phase plate, dielectric gradient or gratings on the rear surface.

Figure 3B:
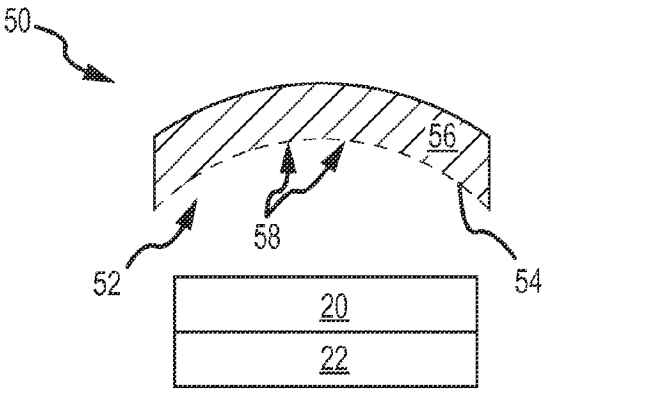
FIGS. 3*a* through 3*d* are diagrams of different embodiments of the RF beam-shaping element.
Figure 3A:
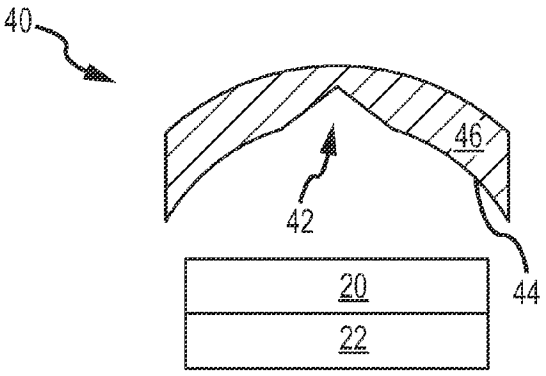

FIG. 3*a* depicts an RF beam-shaping element 40 implemented as a conical cutout 42 in the rear surface 44 of a dielectric element 46. The operation of the element is similar to that of an optical axicon. The air-dielectric interface along the conical cutout causes RF energy to diverge. The air-dielectric interface at the forward surface does not re-converge the RF thereby producing a net-divergent element. This implementation is compatible for use as a discrete component in an RF-only antenna or for integration with the secondary reflector in a common aperture antenna.

FIG. 3*b* depicts an RF beam-shaping element 50 implemented as a printed phase plate structure 52 on the rear surface 54 of a dielectric element 56. The phase plate structure 52 comprises an array of metallic scattering elements 58 printed on the rear surface of the dielectric element. Each element in the scattering array on the phase plate has a scattering phase that is tuned such that the phase plate causes a net divergence in energy similar to the conic cutout without requiring re-shaping of the rear surface of the dielectric element 56. This implementation is compatible for use as a discrete component in an RF-only antenna or for integration with the secondary reflector in a common aperture antenna.

Figure 3D:
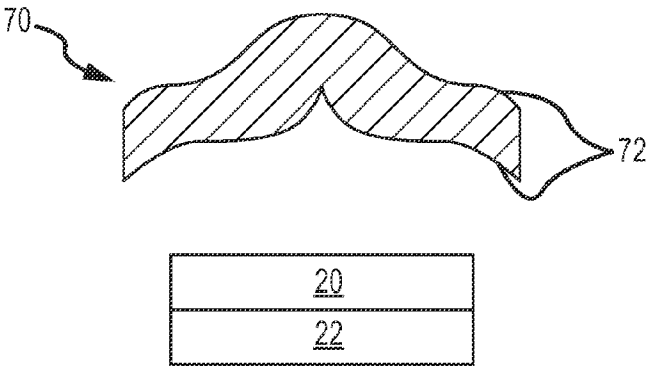
Figure 3C:
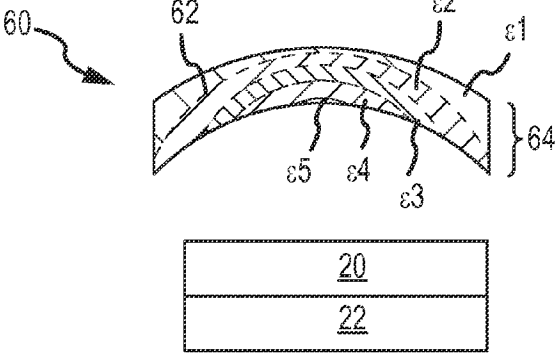

FIG. 3*c* depicts an RF beam-shaping element 60 implemented as a stack of dielectric layers 62 that form a dielectric gradient 64 from the rear surface towards the forward surface. The layers are stacked with progressively increasing dielectric constants $\in_r$ on an angle similar to the conical cutout to steer energy in a similar fashion. The dielectric constants may increase from front-to-rear or rear-to-front. This implementation is compatible for use as a discrete component in an RF-only antenna or for integration with the secondary reflector in a common aperture antenna. The forward most layer of the stack that forms the forward surface is unaffected.

FIG. 3*d* depicts an RF beam-shaping element 70 implemented by shaping both the front and rear surfaces of a dielectric element 72. The surfaces may be optimized to a certain shape that may or may not be easily described by conventional equations. Such an element may be optimized using computer simulations that attempt to optimize the illumination pattern of the feed.

As stated, reflector-based antennas may be used to track targets. One approach, commonly referred to as "monopulse tracking", segments the feed into quadrants. Each quadrant will have one or more feed elements. A sum channel is created when all four quadrants are excited in phase, which is typically the configuration used for transmit mode. This configuration attempts to uniformly illuminate the primary reflector and create a single, main beam in the far field directed along a boresight axis with maximum gain to maximize the measurable range-to-target. Each feed element has a certain polarization, for example linear.

In receive mode, difference, or delta, channels are used to resolve target angular position in Azimuth and Elevation. Such angle estimation is performed by a monopulse network that arithmetically forms these additional difference channels that simultaneously utilize the same antenna elements where two adjacent quadrants are subtracted from the other two quadrants along both the elevation and azimuthal axes. The delta channels typically have a deep null in the center of the antenna radiation pattern with each half of the primary reflector out-of-phase from the other half. High gain of the SUM channel and deep nulls in the DELTA channels improves performance. Further details of the operation of conventional monopulse tracking is well-known and well-documented in technical literature.

RF energy is ideally transmitted and received in a certain polarization (e.g. transmit vertical and receive vertical). The SUM and DELTA channels are ideally pure co-polarized (Co-Pol). However, in reality, the feed may radiate cross-polarized (X-Pol) energy that interferes with the ability to resolve the target.

The center fed RF feed produces a central blockage of the feed pattern that reduces SUM channel gain. In many applications this reduction in SUM channel gain is not acceptable. Conventional wisdom in the industry is that a simple 4-element feed does not produce sufficient SUM channel gain when the blockage region is large relative to the total aperture diameter D. U.S. Pat. No. 6,295,034 overcame the reduction in SUM channel gain by virtue of a specially configured RF feed configured to direct a majority of the RF energy from the feed towards unblocked regions of the primary reflector. This was accomplished by creating an RF Feed with a feed pattern that has a "hole" in its middle. The feed included four feed elements (e.g. patches) per quadrant for a total of sixteen feed elements. By carefully configuring the feed elements, the SUM channel gain was increased. This specially configured 16-element RF provided a reported increase in efficiency of about 20% over a conventional 4-feed monopulse RF feed.

In many reflector-based antennas such as the monopulse-tracking configuration, the use of the RF beam-shaping element to direct the RF energy away from the blockage and toward unblocked regions may allow for simpler feed designs that perform as well as, or better than, the specially configured 16-element feed. The feed design may be simpler in that the feed includes fewer feed elements, in some cases the minimum number of feed elements required to perform the transmit or receive functions absent the blockage. In the case of monopulse tracking, the minimum feed includes only one feed element per quadrant. The feed design may be simpler in that the feeds to and from the radiating elements may be straight or unexposed to received energy. Such simplification may improve other aspects of RF performance such as side-lobe levels or cross-polarization levels.

Figure 4B:
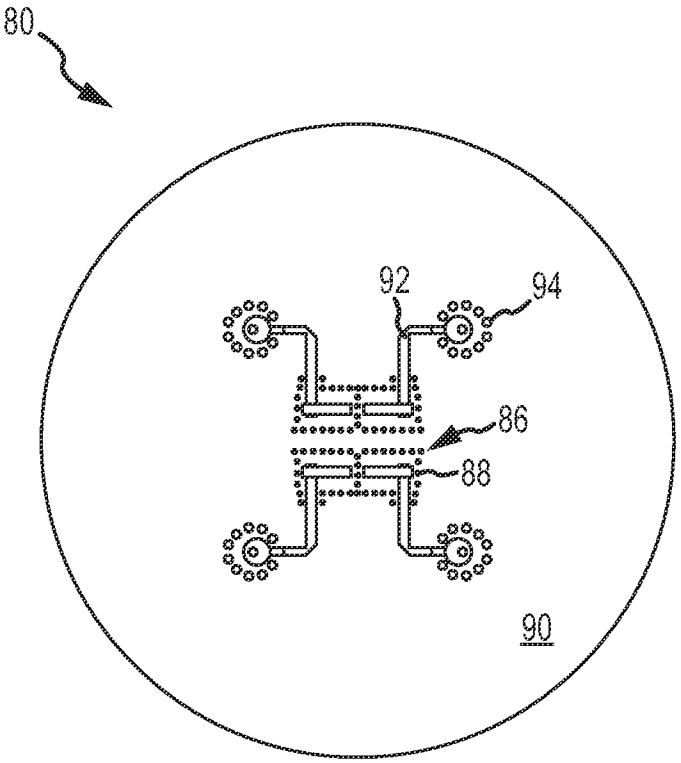
FIGS. 4*a* and 4*b* are a plan view and a plan view without the ground plane of a 4-slot feed for monopulse tracking.
Figure 4A:
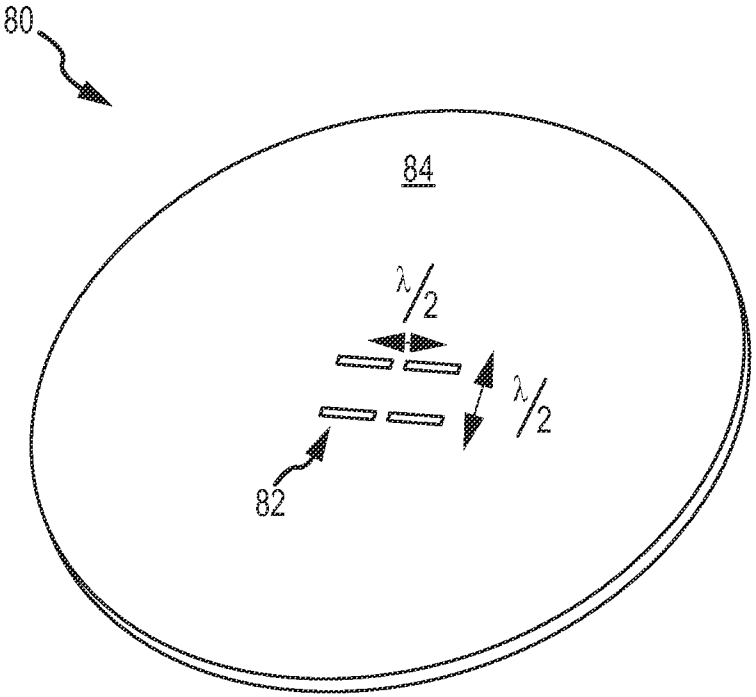

An embodiment of a 4-element cavity-backed slot radiator feed 80 for use in a monopulse tracking reflector-based antenna with an RF beam-shaping element is depicted in FIGS. 4*a* (with ground plane 84) and 4*b* (without ground plane 84). The feed may be constructed using layered printed circuit board (PCB) technology. Feed 80 includes four slots 82, one per quadrant, formed in a ground plane 84 and spaced by approximately one half of the predetermined RF wavelength λ. Ground plane 84 creates a metallic blockage region. Moving the elements much closer than λ/2 apart increases the mutual coupling between the elements to a more than desirable level. Spacing the elements much more than λ/2 apart will increase the effective area of the feed and increase the directivity of the illumination pattern. This pushes more energy towards the center of the dish, and less towards the usable portion of the aperture, which is less desirable. Increasing the spacing of the elements too much more than λ/2 apart will also induce grating lobes.

Feed 80 also includes a feed network that couples the slots 82 to the underlying monopulse network (not shown). The feed network includes a resonant cavity 86 beneath and around each slot 82. The resonant cavity is suitably formed by metal vias 88 formed in a dielectric layer 90 beneath ground plane 84. The cavity is fed by a stripline trace 92 that connects to the monopulse network on an underlying board. Vias 94 are suitably located around the transition to the other board to suppress energy loss in parallel plate modes. Stripline trace 92 is a metallic trace sandwiched between a pair of dielectric layers between two ground planes. The resonant cavities 86 are considerably larger in cross-section than the slots 82. The fact that the feed includes only 4 elements removes the complexity of designing a well-matched feed network to multiple resonant cavities per quadrant within a confined space. Because the stripline traces 92 are formed beneath the ground plane and are thus unexposed to received RF energy, the feed exhibits reduced side lobes and cross-polarization levels. The cavity-backed slot configuration exhibits a clean linear polarization.

In an alternate embodiment, a 4-element feed includes four metallic microstrip patches, one per quadrant, on the surface of a dielectric layer. The microstrip patches may be fed with a coaxial pin through the underlying dielectric or a microstrip trace on the surface of the dielectric layer. The coaxial pins are straight and unexposed to RF energy. The coaxial pins provide a viable option particularly in applications that do not include a monopulse network. Although the microstrip traces are exposed to RF energy and thus susceptible to radiating and receiving cross-polarized energy, because the feed includes only 4 patches the microstrip traces can be kept straight thereby reducing any x-pol component.

Figure 5:
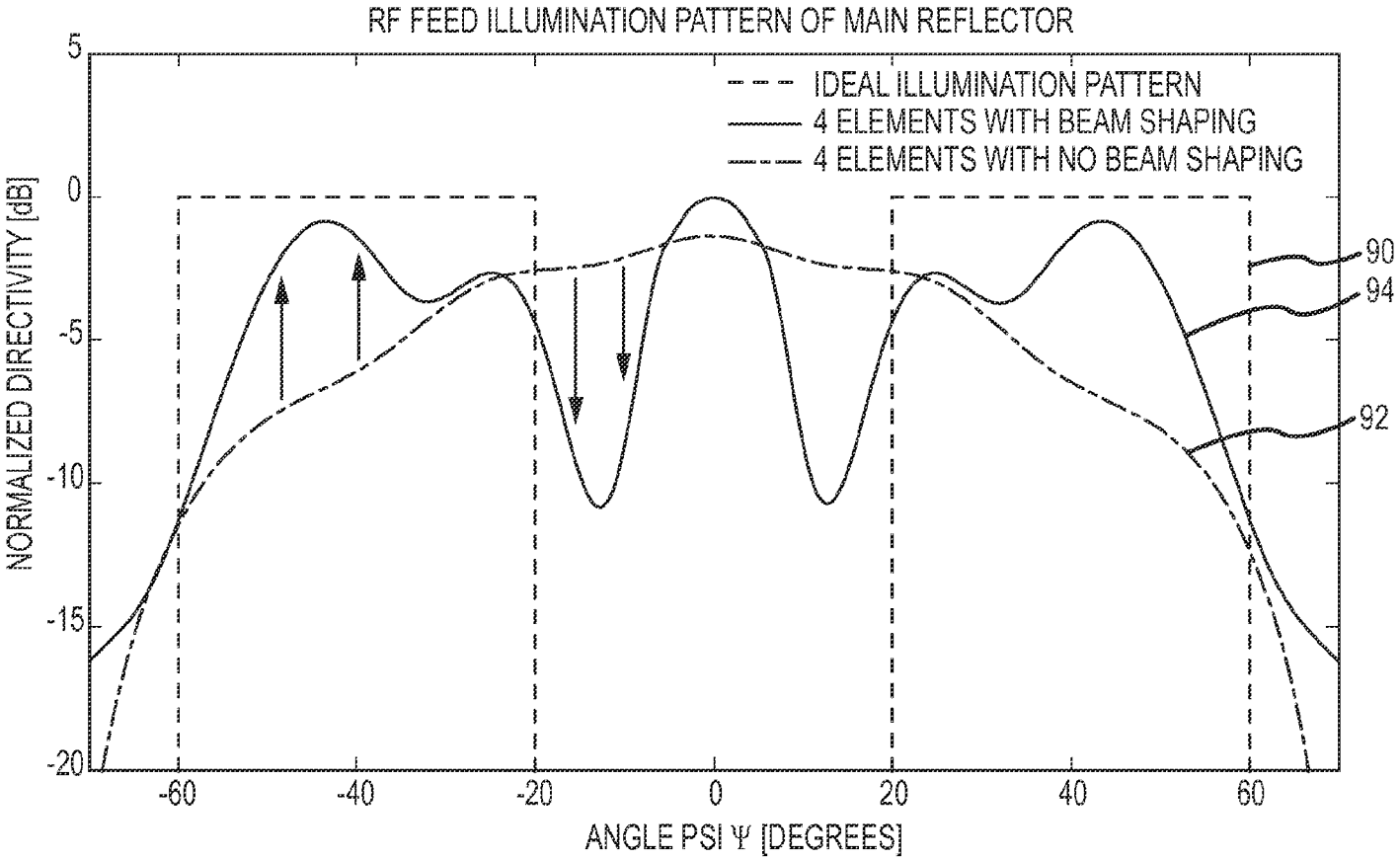
FIG. 5 is a plot of the RF 4-slot feed illumination pattern of the primary reflector in the E-plane.

FIG. 5 is a plot of normalized magnitudes of the illumination pattern of the feed along the E-plane of the antenna vs. the angle psi. The dashed line 90 shows the ideal illumination pattern of the reflective dish. The illumination would be perfectly zero inside the blockage, and outside the edges of the reflector, and would be uniform across the usable unblocked region of the reflector. Under practical constraints, the ideal pattern is not physically realizable. The dotted line 92 shows the illumination pattern of the 4-element feed without a beam-shaping element. A significant portion of the energy is wasted into the blockage region, and that the pattern does not mimic the ideal pattern at all. The solid line 94 shows the 4-element feed with the beam steering element present. Under this configuration, energy is redirected from the blockage region and pushed towards the usable portion of the aperture in the unblocked regions. With the 4-element feed design, the feed itself illuminates the primary reflector such that a maximum power density is radiated toward the blockage of the reflector. The beam-shaping element reshapes the illumination such that the power radiated toward the blockage is reduced and the majority of the radiated power illuminates the unblocked regions.

Figure 6:
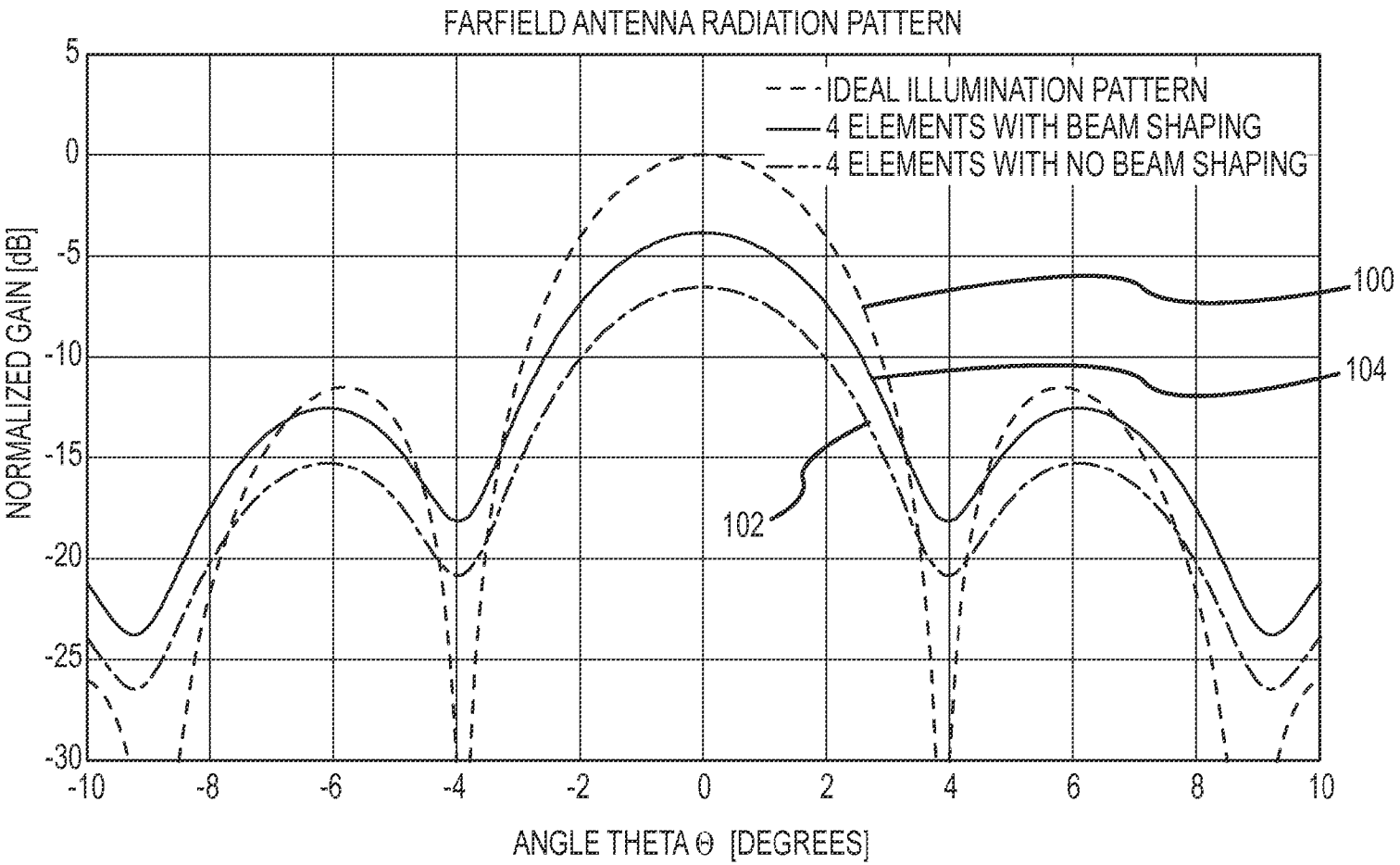
FIG. 6 is a plot of the 4-slot feed's far field antenna radiation pattern in the E-plane.

FIG. 6 is a plot of an antenna pattern gain (SUM channel gain) versus angle theta along the E-plane that corresponds to the three different feeds shown in FIG. 5. Dashed line 100 shows the "ideal pattern" with first sidelobe levels down approximately −2 dB from the main beam due primarily to the blockage region. Dotted line 102 shows the 4-element implementation without beam shaping with a peak gain down approximately −7 dB from the ideal case with first sidelobe levels down approximately −9 dB. Solid line 104 shows that the beam-shaping element increased the peak gain by approximately 2.7 dB, while maintaining sidelobe levels at approximately −9 dB. An increase in peak gain of 2.7 dB represents almost a doubling of the power transmitted in the main beam.

Figure 7A:
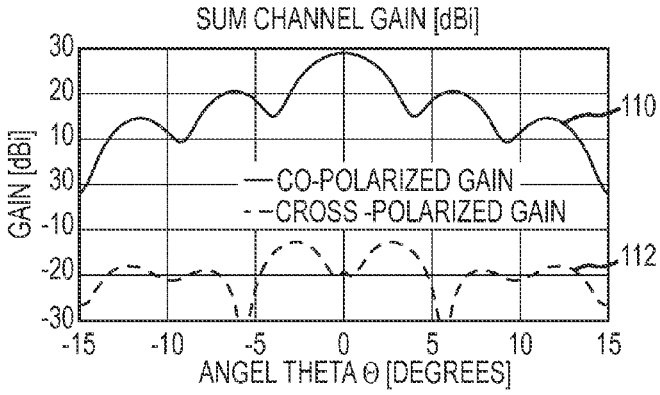
FIGS. 7*a* through 7*c* are plots of the 4-slot feed's co-pol and cross-pol received energy patterns under sum and difference configurations for monopulse tracking.
Figure 7B:
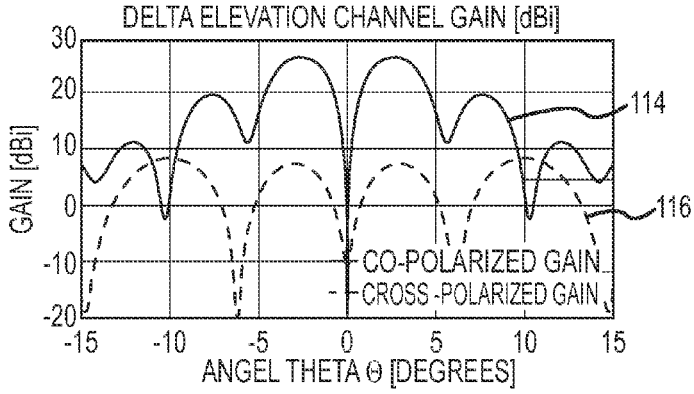
Figure 7C:
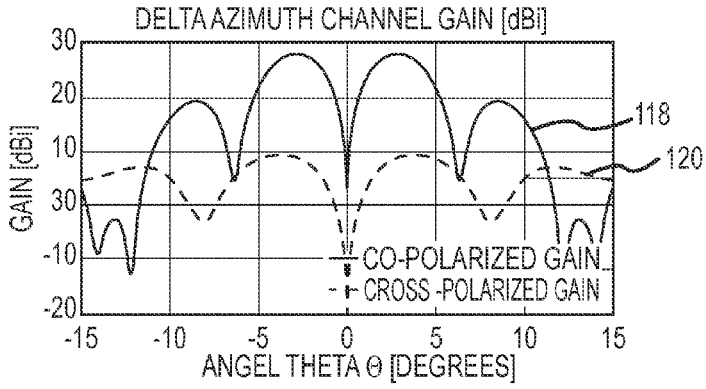

FIG. 7*a* provides plots of SUM channel co-pol gain 110 and cross-pol gain 112 in an elevation plane cut. The two curves show the cross-pol levels to be approximately −35 dB down from the co-pol levels near the main beam. This represents clean linear polarization and is desirable for target tracking applications. FIG. 7*b* provide plots of the DELTA Elevation channel co-pol gain 114 in the elevation plane cut and cross-pol gain 116 in the azimuth plane cut. The cross-pol level is plotted along an orthogonal cut from the co-pol levels because highest cross-polarization levels are typically witnessed in the difference channel's orthogonal plane. The two curves show clean linear co-polarization with cross-pol levels approximately −20 dB down near the main lobes. FIG. 7*c* and provide plots of the DELTA Azimuth channel co-pol gain 118 in the azimuth plane cut and cross-pol gain 120 in the elevation plane cut. The two curves show clean linear co-polarization with cross-pol levels approximately −19 dB down near the main lobes. All three channels exhibit high co-pol gain and low cross-pol gain. Low cross-pol gain combined with high monopulse channel gain levels allows the antenna to resolve and track targets accurately at long range.

Figure 8:
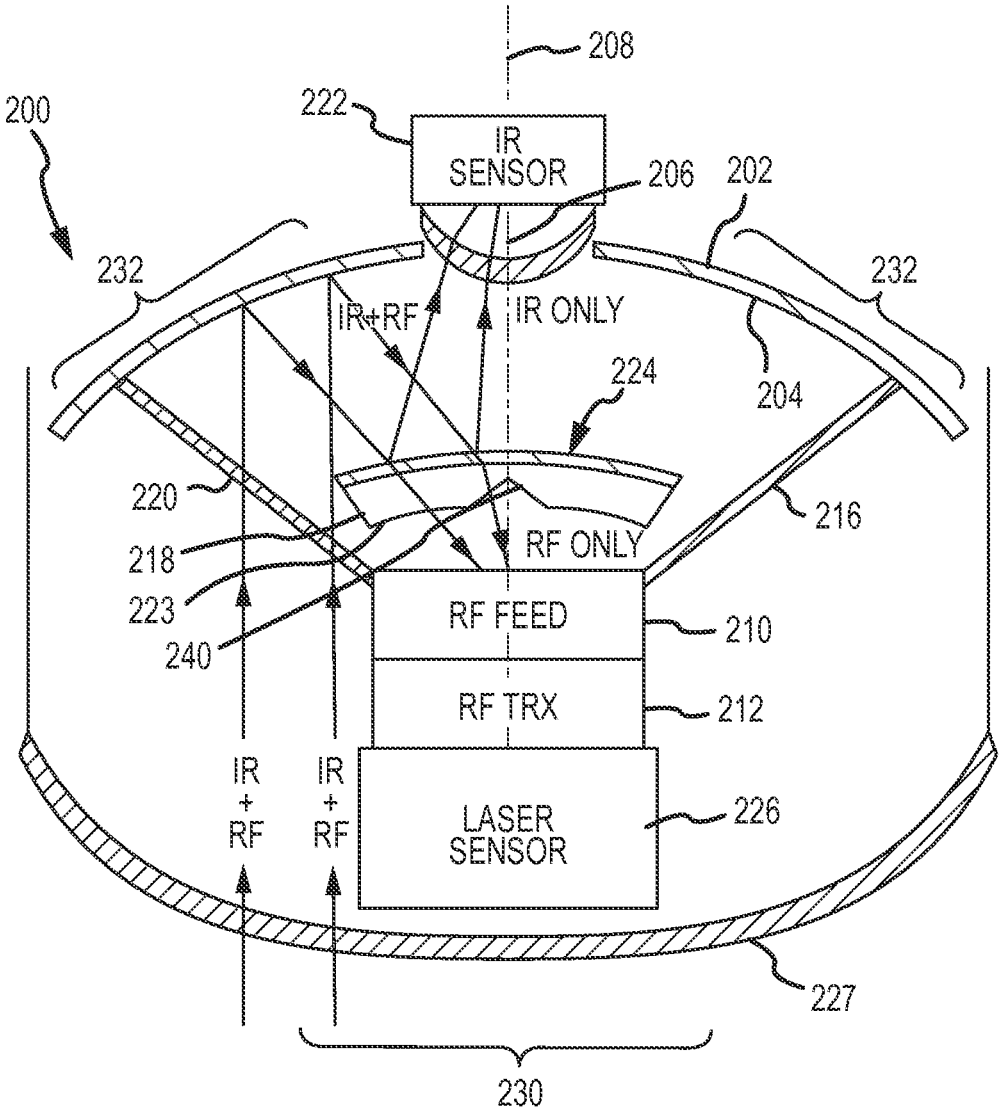
FIG. 8 is a side view of an embodiment of a tri-mode reflector-based antenna including an RF beam-shaping element formed on the rear surface of the secondary reflector that separates the RF and IR energy.

FIG. 8 is a diagram of a common aperture reflector-based antenna 200, in particular a tri-mode seeker for target tracking that combines RF, IR and semi-active laser tracking. The antenna 200 includes a primary reflector 202 having a surface 204 that is reflective to at least RF energy (e.g. RF/microwave/milimeterwave) and IR energy. Primary reflector 202 maps a plane wave at far field to a spherical wave at a focal point FP and vice-versa. Typically, the primary reflector 202 has a parabolic or quasi-parabolic RF cross-section, with focal point FP located at a focal length F from a vertex 206 of the primary reflector 202. This generally parabolic cross-section may be achieved with a physically parabolic cross-section or an electronically parabolic cross-section using a printed phase plate. In this embodiment, an axis 208 of the antenna 200 extends from the vertex 206 of the primary reflector 202 through the focal point FP. In many applications, axis 208 will coincide with a boresight axis of the antenna that points in the direction of maximum antenna gain.

The antenna 200 further includes an RF feed 210 located generally at the focal point FP of the primary reflector 202. RF feed 210 includes one or more feed elements, each element comprising a radiating element such as a cavity-backed slot radiator or microstrip patch and a feed such as a stripline trace or microstrip trace to the radiating element. A transceiver 212 excites the individual feed elements to transmit RF energy. The RF feed 210 illuminates the primary reflector 202 to reflect RF energy along the boresight axis 208 in a collimated beam. In receive mode, the RF feed receives the focused RF energy reflected by the primary reflector 202. The received RF energy at the individual feed elements may be received directly by transceiver 212 or may be provided to an arithmetic network (such as monopulse) that performs arithmetic operations and passes formed sum and difference channel energy to the transceiver. The location and size of RF feed 210 creates a blockage with respect to RF energy on the surface of the primary reflector 12. Support struts 216 also serve to impose blockage on the primary reflector 202, as will be appreciated.

A secondary reflector 218 is positioned between primary reflector 202 and RF feed 210. Secondary reflector 218 has a forward surface 220 facing the primary reflector 202 and an IR sensor 222 and a rear surface 223 facing the RF feed 210. The secondary reflector includes a selective coating 224 on the forward surface that allows transmission of RF energy there through and reflects IR energy to IR sensor 222. The forward surface 220 is shaped to focus the IR energy onto sensor 222.

A laser sensor 226 is mounted in front of RF feed 210 behind a radome 227 to directly receive laser energy reflected off the target. A semi-active laser (SAL) sensor is segmented into quadrants and functions similar to the RF monopulse tracking. The laser sensor 226 may, from necessity, have a relatively large diameter compared to the RF feed 210 and secondary reflector 218.

The antenna feed 210, secondary reflector 218 and laser sensor 226 create a blockage 230 on the surface of primary reflector 202. Unblocked regions 232 of the primary reflector 202 surround blockage 230 and define the usable portion of the aperture. The blockage has negative effects on the antenna's performance, including reduction in antenna gain and an increase in side lobe levels.

An RF beam-shaping element 240 is formed on only the rear surface 223 of the secondary reflector 218. The RF beam-shaping element is configured to direct RF energy from the feed away from the blockage 230 towards unblocked regions 232 of the primary reflector 202. The RF beam-shaping element is formed on only the rear surface so as to have no impact on the forward surface 220 and the selective coating 224 formed thereon, hence no impact on the IR performance. The embodiments of the RF beam-shaping element shown in FIGS. 3*a*, 3*b* and 3*c* fulfill this criterion.

In an alternate embodiment, a discrete RF beam-shaping element could be positioned between the secondary reflector 218 and RF feed 210 to direct the RF energy around the blockage. However, inclusion of an additional discrete element increases footprint, weight and cost. Integration of the RF beam-shaping element with the secondary reflector without impacting IR performance is preferred.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A reflector-based antenna, comprising:

a primary reflector having a focal point;

an antenna feed spaced from the primary reflector and located at approximately the focal point for illuminating the primary reflector with or receiving from the primary reflector radio frequency (RF) energy, said feed forming a central blockage of the primary reflector along a boresight axis; and an RF beam-shaping element formed of a dielectric material and located between the primary reflector and the antenna feed, said dielectric material configured with a non-flat front surface facing the primary reflector and a non-flat rear surface facing the antenna feed, said front and rear surfaces having different curvatures such that the dielectric material has non-uniform thickness, said dielectric material being thinner near the boresight axis to steer RF energy from the feed that is transmitted through the dielectric material away from the central blockage towards unblocked regions of the primary reflector such that power radiated toward the central blockage from the feed is reduced and the majority of the radiated power illuminates the unblocked regions of the primary reflector, wherein the curved front and rear surfaces are configured such that RF beam-shaping element is net-divergent in that the element causes more RF energy to diverge away from the boresight axis than to converge towards the boresight axis.

2. The antenna of claim 1, wherein the primary reflector has a generally parabolic reflective surface, said boresight axis extending from a vertex of the primary reflector through the focal point.

3. The antenna of claim 1, wherein the feed illuminates the primary reflector such that absent the RF beam-shaping a maximum power density would be radiated toward the central blockage.

4. The antenna of claim 1, wherein only the rear surface of the dielectric material is shaped to direct RF energy from the feed away from the central blockage.

5. The antenna of claim 1, wherein the feed transmits or receives RF energy of a first predefined RF wavelength, further comprising:

a sensor opposite the antenna feed for receiving or transmitting energy of a second predefined wavelength different from the first predefined RF wavelength from the primary reflector;

wherein the front surface comprises a selective coating on the dielectric material that allows transmission of RF energy at the first predefined RF wavelength there through and reflects and focuses energy of the second predefined wavelength.

6. The antenna of claim 5, wherein only the rear surface of the dielectric material is shaped to direct RF energy from the feed away from the central blockage.

7. The antenna of claim 6, wherein the rear surface is shaped with a conical cutout in the curvature of the rear surface.

8. The antenna of claim 1, wherein said antenna feed comprises only one to four feed elements, each said element comprising a radiating element and a feed to the radiating element, said feed being straight or positioned behind a ground plane so that the feed is unexposed to received RF energy.

9. The antenna of claim 8, wherein the radiating element comprises a cavity-backed slot radiator formed in said ground plane and the unexposed feed comprises a stripline trace.

10. The antenna of claim 1, wherein the antenna feed is segmented into quadrants, each quadrant comprising a single said feed element, said four feed elements spaced by approximately one-half the RF wavelength, further comprising:

a transceiver for energizing and accepting RF energy from the single feed elements on each said quadrant to estimate first and second orthogonal angles to an illuminated target using sum and difference configurations of the four feed elements.

11. The antenna of claim 10, wherein the transceiver energizes all four feed elements in-phase.

12. The antenna of claim 1, wherein at least one of said front and rear surfaces has a non-uniform curvature.

13. A reflector-based antenna, comprising:

a primary reflector having a focal point;

an antenna feed spaced from the primary reflector and located approximately at the focal point for illuminating the primary reflector with or receiving from the primary reflector radio frequency (RF) energy of a first predefined RF wavelength;

a sensor for receiving or transmitting energy of a second predefined wavelength different from the predefined RF wavelength from the primary reflector;

a secondary reflector having a forward surface facing the primary reflector and the sensor and a rear surface facing the antenna feed, said secondary reflector comprising a selective coating on the forward surface that allows transmission energy at the first predefined RF wavelength there through and reflects energy of the second predefined wavelength, said antenna feed, said secondary reflector and said sensor creating a central blockage of the primary reflector along a boresight axis, said forward and rear surfaces having different curvatures such that the dielectric material has non-uniform thickness, said dielectric material being thinner near the boresight axis to steer energy from the feed that is transmitted through the dielectric material away from the central blockage towards unblocked regions of the primary reflector.

14. The antenna of claim 13, wherein the antenna feed is segmented into quadrants, each quadrant comprising a single said feed element, further comprising:

a transceiver for energizing and accepting RF energy from the single feed elements on each said quadrant to estimate first and second orthogonal angles to an illuminated target using sum and difference configurations of the four feed elements.

15. The antenna of claim 13, wherein the forward and rear surfaces are configured such that RF beam-shaping element is net-divergent in that the element causes more RF energy to diverge away from the boresight axis than to converge towards the boresight axis.

16. The antenna of claim 13, wherein at least one of said front and rear surfaces has a non-uniform curvature.

17. A reflector-based antenna, comprising:

a primary reflector having a focal point;

an antenna feed spaced from the primary reflector and located at approximately the focal point for illuminating the primary reflector with or receiving from the primary reflector radio frequency (RF) energy, said feed forming a blockage of the primary reflector; and an RF beam-shaping element located between the primary reflector and the antenna feed, said RF beam shaping element comprising a conical cutout formed in a rear surface of a dielectric material facing the antenna feed that directs RF energy from the feed that is transmitted through the dielectric material away from the blockage towards unblocked regions of the primary reflector.

* * * * *